US008689909B2

(12) United States Patent
DiGiovanni

(10) Patent No.: US 8,689,909 B2
(45) Date of Patent: Apr. 8, 2014

(54) INSERTS, POLYCRYSTALLINE DIAMOND COMPACT CUTTING ELEMENTS, EARTH-BORING BITS COMPRISING SAME, AND METHODS OF FORMING SAME

(75) Inventor: Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/274,960

(22) Filed: Oct. 17, 2011

(65) Prior Publication Data

US 2012/0103697 A1 May 3, 2012

Related U.S. Application Data

(60) Provisional application No. 61/408,398, filed on Oct. 29, 2010.

(51) Int. Cl.
*E21B 10/36* (2006.01)

(52) U.S. Cl.
USPC ..... 175/425; 175/434; 175/428; 175/426; 51/293; 51/307

(58) Field of Classification Search
USPC ..... 175/434, 428, 426, 425; 51/307, 293
See application file for complete search history.

(56) References Cited

U.S. PATENT DOCUMENTS

| | | | | |
|---|---|---|---|---|
| 3,745,623 | A | 7/1973 | Wentorf, Jr. et al. | |
| 5,127,923 | A | 7/1992 | Bunting et al. | |
| 5,855,997 | A * | 1/1999 | Amateau | 428/212 |
| 5,954,147 | A | 9/1999 | Overstreet et al. | |
| 6,099,605 | A | 8/2000 | Cook et al. | |
| 6,432,855 | B1 | 8/2002 | Cook et al. | |
| 6,772,849 | B2 * | 8/2004 | Oldham et al. | 175/433 |
| 6,921,422 | B2 | 7/2005 | Cook et al. | |
| 7,172,641 | B2 | 2/2007 | Cook et al. | |
| 7,238,429 | B2 | 7/2007 | Cook et al. | |
| 7,375,343 | B1 | 5/2008 | Cook et al. | |
| 7,517,375 | B2 | 4/2009 | Cook et al. | |
| 2007/0160830 | A1 * | 7/2007 | Egan et al. | 428/336 |
| 2007/0175672 | A1 * | 8/2007 | Eyre et al. | 175/426 |
| 2008/0085407 | A1 | 4/2008 | Cooley et al. | |

(Continued)

OTHER PUBLICATIONS

Kliener, Kurt, "material slicker than Teflon discovered by accident", Nov. 2008, NewScientist.*

(Continued)

*Primary Examiner* — Jennifer H Gay
*Assistant Examiner* — Taras P Bemko
(74) *Attorney, Agent, or Firm* — TraskBritt

(57) ABSTRACT

An insert for an earth-boring tool includes a body and a coating disposed over at least a portion of the body. The coating comprises a ceramic comprising boron, aluminum, and magnesium. Polycrystalline diamond compact cutting elements may include a hard polycrystalline material, a supporting substrate, and a coating disposed over at least a portion of the hard polycrystalline material. An earth-boring drill bit may include a bit body and at least one polycrystalline diamond compact cutting element secured to the bit body. The polycrystalline diamond compact cutting element may have a coating comprising a ceramic of boron, aluminum, and magnesium, and may be disposed over at least a portion of a hard polycrystalline material. A method of forming an insert for an earth-boring tool may include forming a protective coating including a ceramic of boron, aluminum, and magnesium over a cutting element.

17 Claims, 6 Drawing Sheets

(56) References Cited

U.S. PATENT DOCUMENTS

| | | | | |
|---|---|---|---|---|
| 2008/0308276 | A1* | 12/2008 | Scott | 166/298 |
| 2011/0031034 | A1 | 2/2011 | DiGiovanni et al. | |
| 2011/0088950 | A1 | 4/2011 | Scott et al. | |
| 2011/0168451 | A1 | 7/2011 | DiGiovanni et al. | |

OTHER PUBLICATIONS

Wray, Peter, "More BAM stuff!", Dec. 17, 2008, Ceramic Tech Today.*

* cited by examiner

INSERTS, POLYCRYSTALLINE DIAMOND COMPACT CUTTING ELEMENTS, EARTH-BORING BITS COMPRISING SAME, AND METHODS OF FORMING SAME

CROSS-REFERENCE TO RELATED APPLICATION

This application claims the benefit of U.S. Provisional Patent Application Ser. No. 61/408,398, filed Oct. 29, 2010, titled "Protective Coatings, Polycrystalline Compacts and Drill Bits Comprising Such Coatings, and Methods of Forming Such Coatings, Compacts, and Drill Bits," the disclosure of which is incorporated herein in its entirety by this reference.

FIELD

Embodiments of the present disclosure relate generally to protective coatings for use on, by way of non-limiting example, inserts, polycrystalline compacts, drill bits, and other earth-boring tools, and to methods of forming such protective coatings.

BACKGROUND

Cutting elements used in earth-boring tools often include polycrystalline diamond compact (often referred to as "PDC") cutting elements, which are cutting elements that include cutting faces of a polycrystalline diamond material. Polycrystalline diamond material is material that includes inter-bonded grains or crystals of diamond material. In other words, polycrystalline diamond material includes direct, inter-granular bonds between the grains or crystals of diamond material. The terms "grain" and "crystal" are used synonymously and interchangeably herein.

PDC cutting elements are foamed by sintering and bonding together relatively small diamond grains under conditions of high temperature and high pressure in the presence of a catalyst (for example, cobalt, iron, nickel, or alloys or mixtures thereof) to form a layer or "table" of polycrystalline diamond material on a cutting element substrate. These processes are often referred to as high-temperature/high-pressure (or "HTHP") processes. The cutting element substrate may comprise a cermet material (i.e., a ceramic-metal composite material) such as cobalt-cemented tungsten carbide. In such instances, the cobalt (or other catalyst material) in the cutting element substrate may diffuse into the diamond grains during sintering and serve as the catalyst material for forming the inter-granular diamond-to-diamond bonds, and the resulting diamond table, from the diamond grains. In other methods, powdered catalyst material may be mixed with the diamond grains prior to sintering the grains together in an HTHP process.

Upon formation of a diamond table using an HTHP process, catalyst material may remain in interstitial spaces between the grains of diamond in the resulting polycrystalline diamond table. The presence of the catalyst material in the diamond table may contribute to thermal damage in the diamond table when the cutting element is heated during use, due to friction at the contact point between the cutting element and the rock formation being cut.

PDC cutting elements in which the catalyst material remains in the diamond table are generally thermally stable up to a temperature of about 750° C., although internal stress within the cutting element may begin to develop at temperatures exceeding about 400° C. due to a phase change that occurs in cobalt at that temperature (a change from the "beta" phase to the "alpha" phase). Also beginning at about 400° C., there is an internal stress component that arises due to differences in the thermal expansion of the diamond grains and the catalyst material at the grain boundaries. This difference in thermal expansion may result in relatively large tensile stresses at the interface between the diamond grains, and may contribute to thermal degradation of the microstructure when PDC cutting elements are used in service. Differences in the thermal expansion between the diamond table and the cutting element substrate to which it is bonded may further exacerbate the stresses in the polycrystalline diamond compact. This differential in thermal expansion may result in relatively large compressive and/or tensile stresses at the interface between the diamond table and the substrate that eventually leads to the deterioration of the diamond table, causes the diamond table to delaminate from the substrate, or results in the general ineffectiveness of the cutting element.

Furthermore, at temperatures at or above about 750° C., some of the diamond crystals within the diamond table may react with the catalyst material causing the diamond crystals to undergo a chemical breakdown or conversion to another allotrope of carbon. For example, the diamond crystals may graphitize at the diamond crystal boundaries, which may substantially weaken the diamond table. Also, at extremely high temperatures, in addition to graphite, some of the diamond crystals may be converted to carbon monoxide and/or carbon dioxide.

In order to reduce the problems associated with differences in thermal expansion and chemical breakdown of the diamond crystals in PDC cutting elements, so-called "thermally stable" polycrystalline diamond compacts (which are also known as thermally stable products, or "TSPs") have been developed. Such a TSP may be formed by leaching the catalyst material (e.g., cobalt) out from interstitial spaces between the inter-bonded diamond crystals in the diamond table using, for example, an acid or combination of acids (e.g., aqua regia). A substantial amount of the catalyst material may be removed from the diamond table, or catalyst material may be removed from only a portion thereof. TSPs in which substantially all catalyst material has been leached out from the diamond table have been reported to be thermally stable up to temperatures of about 1,200° C. It has also been reported, however, that such fully leached diamond tables are relatively more brittle and vulnerable to shear, compressive, and tensile stresses than are non-leached diamond tables. In addition, it may be difficult to secure a completely leached diamond table to a supporting substrate. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In some embodiments of the disclosure, an insert for an earth-boring tool may include a body and a coating disposed over at least a portion of the body. The coating may comprise a ceramic comprising boron, aluminum, and magnesium.

In other embodiments, a polycrystalline diamond compact cutting element may include a hard polycrystalline material, a supporting substrate, and a coating disposed over at least a portion of the hard polycrystalline material. The coating may comprise a ceramic of boron, aluminum, and magnesium.

In other embodiments, an earth-boring drill bit may include a bit body and at least one polycrystalline diamond compact cutting element secured to the bit body. The polycrystalline diamond compact cutting element may have a coating comprising a ceramic of boron, aluminum, and magnesium, and may be disposed over at least a portion of a hard polycrystalline material.

A method of forming an insert for an earth-boring tool may include forming a protective coating over a cutting element. The protective coating may include a ceramic of boron, aluminum, and magnesium.

BRIEF DESCRIPTION OF THE DRAWINGS

While the specification concludes with claims particularly pointing out and distinctly claiming what are regarded as embodiments of the invention, various features and advantages of embodiments of the disclosure may be more readily ascertained from the following description of some embodiments of the disclosure when read in conjunction with the accompanying drawings, in which:

DETAILED DESCRIPTION

Figure 1:
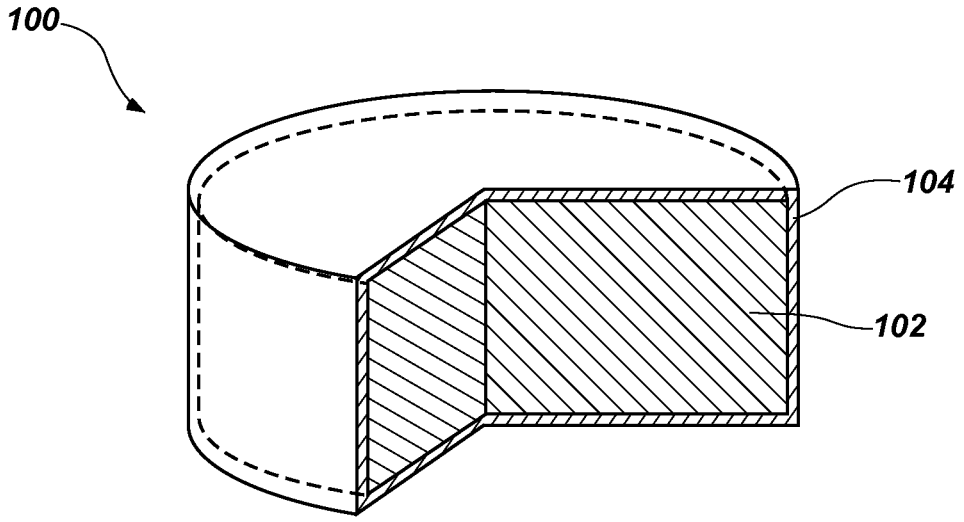
FIGS. 1 and 2 are perspective cutaway views of embodiments of an insert for earth-boring tools of the present disclosure.

The illustrations presented herein are not actual views of any particular coating, insert, polycrystalline compact, earth-boring tool, or drill bit, and are not drawn to scale, but are merely idealized representations, which are employed to describe embodiments of the disclosure. Elements common between figures may retain the same numerical designation.

As used herein, the term "drill bit" means and includes any type of bit or tool used for drilling during the formation or enlargement of a wellbore and includes, for example, rotary drill bits, percussion bits, core bits, eccentric bits, bicenter bits, reamers, expandable reamers, mills, drag bits, roller cone bits, hybrid bits, and other drilling bits and tools known in the art.

As used herein, the term "formed over" means and includes formed on, over, and/or around a material. A layer may be formed over (that is, on, over, and/or around) another material by depositing, growing, or otherwise providing a layer of material on, over, and/or around the another material. The particular process used to deposit each layer will depend upon the particular material composition of that layer, the composition of the another material, the geometry of the another material and the layer, etc.

As used herein, the term "inter-granular bond" means and includes any direct atomic bond (e.g., covalent, metallic, etc.) between atoms in adjacent grains of material.

The term "polycrystalline material" means and includes any material comprising a plurality of grains (i.e., crystals) of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to a precursor material or materials used to form the polycrystalline material. "Polycrystalline diamond compacts" or PDCs are a type of polycrystalline compact that includes inter-bonded grains or crystals of diamond material. Cutting elements having PDCs are often referred to as "PDC cutters" or "PDC cutting elements." The cutting elements may be fabricated separately from the bit body and are secured within pockets formed in the outer surface of the bit body.

As used herein, the term "BAM" means and includes a ceramic including boron, aluminum, and magnesium. For example, BAM may include $AlMgB_{14}$, $Al_{0.75}Mg_{0.78}B_{14}$, and materials having other ratios of boron, aluminum, and magnesium. Other materials, such as TiB, $TiB_2$, Si, P, AlN, or BN, may be included in BAM.

BAM may have a low coefficient of friction. For example, BAM may have a coefficient of friction of about 0.04 or less, or a coefficient of friction of about 0.02. Addition of other materials may alter the coefficient of friction. For example, BAM with $TiB_2$ may have a lower coefficient of friction than BAM alone.

BAM may have a hardness of from about 20 GPa to about 50 GPa, as measured by ASTM Standard C1326 (Standard Test Method for Knoop Indentation Hardness of Advanced Ceramics, ASTM Int'l, West Conshohocken, Pa. (2008)). For example, in certain formulations, $AlMgB_{14}$ may have a hardness of from about 32 GPa to about 35 GPa, while composites of $AlMgB_{14}$ and $TiB_2$ may have a hardness of from about 40 GPa to about 46 GPa.

FIG. 1 is a simplified drawing illustrating a perspective cutaway view of an embodiment of an insert 100 for an earth-boring tool having an insert body 102 and a protective coating 104 formed over the insert body 102.

The insert 100 may be a cutting element, a wear-resistant insert, or any other insert for an earth-boring tool. For example, a cutting element may contact and remove material in earth-boring operations. A wear-resistant insert may contact one or more portions of an earth-boring tool, and may be configured to prevent wear within the tool. The insert 100 may be used for industrial operations such as cutting, grinding, chopping, drilling, or milling.

The insert body 102 may comprise a volume of one or more hard polycrystalline materials such as carbides, nitrides, borides, etc. For example, the insert body 102 may comprise polycrystalline diamond, cubic boron nitride, silicon nitride, silicon carbide, titanium carbide, tungsten carbide (e.g., cobalt-cemented tungsten carbide), tantalum carbide, or another hard material. The insert body 102 may have any desirable shape, such as cylindrical, conical, prismatic, etc. The insert body 102 may be of a size and configuration such that the insert 100 may be used as a PDC cutter. Such inserts 100 may be configured to be secured within an earth-boring tool.

The protective coating 104 may comprise BAM or BAM compositions. BAM compositions may be based on four $B_{12}$ icosahedral units positioned within an orthorhombic unit cell comprising 64 atoms. The icosahedral units may be positioned at (0, 0, 0), (0, ½, ½), (½, 0, 0), and (½, ½, ½), while the aluminum atoms may occupy a four-fold position at (¼, ¾, ¼), and the magnesium atoms may occupy a four-fold position at (0.25, 0.359, 0). The hardness and wear resistance of this material may be due to complex interactions within each icosahedron (i.e., intrahedral bonding) combined with interactions between the icosahedra (i.e., intericosahedral bonding). The hexagonal icosahedra may be arranged in distorted, close-packed layers.

For example, the protective coating 104 may comprise one or more BAM compositions, such as BAM-$TiB_2$ composites. Some examples of materials that may be used as coatings are materials sold under the trade name "Borzonite" by New Tech Ceramics, Inc., of Boone, Iowa (such as BZN 101 ($AlMgB_{14}$), BZN 201 ($Al_{0.75}Mg_{0.78}B_{14}$), BZN 301 ($AlMgB_{14}$ and $TiB_2$), BZN 501 ($Al_2O_3$ and $TiB_2$), BZN 601 ($TiB_2$, TiC, Fe, Ni, and C), BZN 801 ($Si_3N_4$ (whiskered)), BZN 811 ($Si_3N_4$ (whiskered)), BZN 812 ($Si_3N_4$), and BZN 1001 ($B_4C$)). "Whiskered" material may comprise a plurality of composite fibers. Such fibers may divert and deflect the propagation of cracks through the protective coating 104. The fibers may be, for example, from about 10 nm to about 500 μm long, from about 1 μm to about 200 μm long, or from about 5 μm to about 100 μm long. The fibers may have diameters of, for example, from about 1 nm to about 10 μm, from about 1 nm to about 100 nm, from about 5 nm to about 50 nm, or from 500 nm to 10 μm.

As another example, thin film coatings may be used, such as those sold under the trade names CNTC 3001 ($B_4C$ and $W_2B_5$), CNTC 3002 ($Al_2O_3$ and $TiB_2$), CTNC 3003 ($AlMgB_{14}$), CTNC 3004 ($AlMgB_{14}$ and $TiB_2$), CTNC 3005 ($AlMgB_{14}$ and $W_2B_4$), and CTNC 3006 ($AlMgB_{14}$ and $B_4C$), available from New Tech Ceramics, Inc. The protective coating 102 may be any material containing BAM, plus, optionally, one or more other materials.

The protective coating 104 is shown in FIG. 1 with an exaggerated thickness for purposes of illustration. The protective coating 104 may be a thin film (for example, having a thickness from a single monolayer to about 5 μm, from about 5 nm to about 500 nm, or from about 10 nm to about 100 nm). In some embodiments, the protective coating may have a thickness of about 100 nm, 500 nm, 1 μm, or 5 μm.

The protective coating 104 may be applied to the insert body 102 by any deposition technique for providing a material over a surface. The protective coating 104 may comprise BAM with one or more additional materials. BAM compounds may be formed as described in U.S. Pat. No. 6,099,605, titled "Superabrasive Boride and a Method of Preparing the Same by Mechanical Alloying and Hot Pressing," issued Aug. 8, 2000, the disclosure of which is incorporated herein in its entirety by this reference. For example, stoichiometric amounts of boron, magnesium, and aluminum may be combined with from about 5 to about 30 weight percent or atomic percent of additional materials. The mixture may then be mechanically ground (e.g., milled) to form a powder. In some embodiments, the powder may be applied to surfaces and then sintered to form the protective coating 104.

Additional materials may be elements or compounds, and may include structures, such as fibers or whiskers. Additional materials may include, for example, titanium boride ($TiB_2$), titanium carbide (TiC) plus iron, nickel and carbon, silicon nitride ($Si_3N_4$) as a powder or whiskered, boron carbide ($B_4C$), titanium boride ($TiB_2$), or tungsten boride ($W_2B_4$). Mixing BAM with additional materials may increase the hardness of the resulting protective coating 104 by 10% to 20%, depending on the material and concentration used.

Protective coatings 104 may be applied as ceramic powders, ceramic coatings, thin film coatings sputtered from targets, thick film laser-formed or ablated powders, thick film plasma spray powders, or other coating techniques. Atoms of protective coating 104 may form inter-granular bonds with other atoms of protective coating 104 or with the insert 100 for an earth-boring tool having an insert body 102.

The protective coating 104 may be patterned on the insert 100 for an earth-boring tool having an insert body 102 to allow for controlled abrasion (i.e., lip formation or brazing adherence on tungsten carbide substrates), as will become apparent in the description of FIGS. 2 through 10. The protective coating 104 may be used in combination with other superabrasive substrates or coatings. The protective coating 104 may also be used as abrasion-resistant coatings in other tribological material applications (e.g., on bearings, gears, or other wear surfaces). Protective coatings 104 may be used to realize greater efficiencies and lifetimes of earth-boring tools, especially at elevated temperatures found in subterranean rock drilling. Protective coatings 104 may delay, retard, or mitigate degradation of an insert 100. For example, the protective coating 104 may limit abrasion, erosion, corrosion, chipping, cracking, fracture, spallation, thermal degradation, etc.

Figure 2:
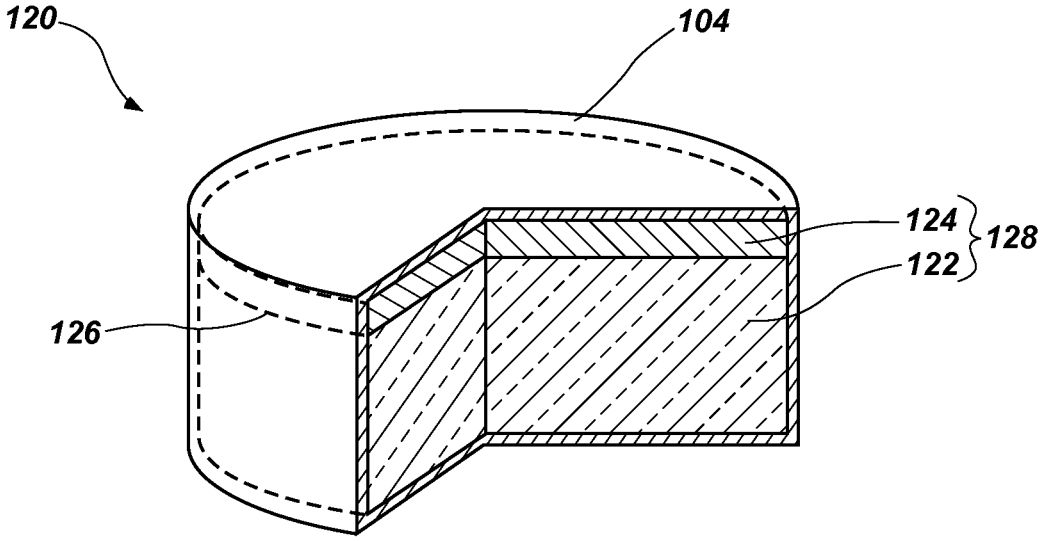

FIG. 2 is a simplified perspective drawing illustrating a cutaway view of another embodiment of an insert 120 having a protective coating 104 formed over the insert 120. The insert 120 may include a table or layer of hard polycrystalline material 124 that has been provided on (e.g., formed on or secured to) a surface of a supporting substrate 122. The hard polycrystalline material 124 may be a polycrystalline compact or a PDC. The hard polycrystalline material 124 may comprise a volume of polycrystalline diamond or cubic boron nitride. The supporting substrate 122 may comprise a volume of silicon nitride, silicon carbide, titanium carbide, tungsten carbide, tantalum carbide (e.g., cobalt-cemented tungsten carbide), or another hard material.

Together, the supporting substrate 122 and the hard polycrystalline material 124 may be referred to as a PDC cutting element 128. Some methods of formation of PDC cutting elements 128 are described more fully in U.S. Patent Application Publication 2011/0031034 A1, titled "Polycrystalline Compacts Including In-Situ Nucleated Grains, Earth-Boring Tools Including Such Compacts, and Methods of Forming Such Compacts and Tools," Published Feb. 10, 2011, the disclosure of which is incorporated herein in its entirety by this reference. Embodiments of PDC cutting elements 128 described therein may be coated with one or more protective coatings 104 to form any of the inserts described herein, such as inserts 100, 120, or any of inserts 130, 140, 150, 160, 170, 176, 180, 186, or 204, described below and shown in FIGS. 3 through 11. Furthermore, PDC cutting elements 128 formed by any other method now known or developed in the future may be coated with the one or more protective coatings 104 described herein to form inserts 120. Embodiments of the disclosure may provide an overall polycrystalline microstructure within the protective coating 104 and between the protective coating 104 and the PDC cutting element 128. The polycrystalline microstructure may provide improved durability, conductivity, and thermal stability in comparison with PDC cutting elements 128 without protective coating 104.

An interface 126, as shown by a broken line, may define a boundary between the supporting substrate 122 and the hard polycrystalline material 124. The interface 126 may or may not be visible in an insert 120 that has been sectioned or cut. The hard polycrystalline material 124 or the supporting substrate 122 may comprise diamond grains, and optionally, one or more materials that are catalytic or partially catalytic to diamond synthesis (e.g., a group VIII-A element such as iron, cobalt, or nickel, or an alloy thereof). The hard polycrystalline material 124 or the supporting substrate 122 may comprise abrasive materials such as carbides (e.g., tungsten carbide, silicon carbide), nitrides, borides, etc., or combinations thereof.

In some embodiments, the hard polycrystalline material 124 may be formed over a supporting substrate 122 (as shown in FIG. 2) of cemented tungsten carbide or another suitable substrate material in a conventional HTHP process. Such processes, and systems for carrying out such processes, are generally known in the art. For example, the hard polycrystalline material 124 may be formed as described, by way of non-limiting example, in U.S. Pat. No. 3,745,623, titled "Diamond Tools for Machining," issued Jul. 17, 1973, or may be formed as a freestanding polycrystalline compact (i.e., without the supporting substrate 122) in a similar conventional HTHP process as described, by way of non-limiting example, in U.S. Pat. No. 5,127,923, titled "Composite Abrasive Compact Having High Thermal Stability," issued Jul. 7, 1992, the disclosure of each of which is incorporated herein in its entirety by this reference.

The protective coating 104 may be formed over the entire exterior surface of the insert 120 (i.e., over the entire exterior surface of the supporting substrate 122 and the hard polycrystalline material 124), and may be formed by the methods described with reference to FIG. 1.

Figure 3:
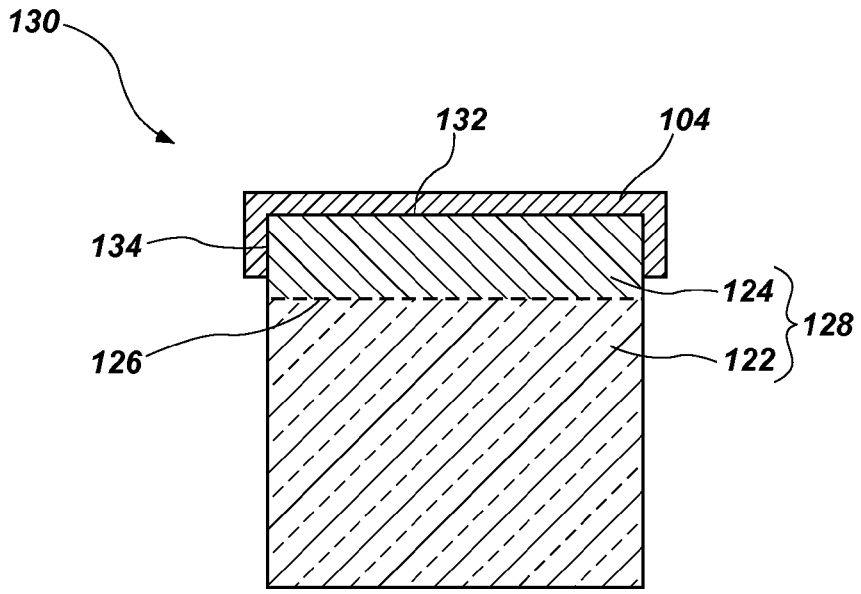
FIGS. 3 through 6 illustrate section cutaway views of embodiments of inserts for earth-boring tools of the present disclosure.

FIG. 3 is a simplified drawing illustrating a cutaway view of an embodiment of an insert 130 having a protective coating 104 formed over a portion thereof. Note that for convenience of illustration, FIGS. 3 through 6 are section cutaway views (i.e., orthographic views of inserts that have been cut along a plane), rather than the perspective views of FIGS. 1 and 2. Like the insert 120 shown in FIG. 2, the insert 130 may have a PDC cutting element 128 comprising a supporting substrate 122, a table or layer of hard polycrystalline material 124, and an interface 126, as shown by broken line. Alternatively, the insert 130 may be formed without the supporting substrate 122 or the interface 126. The protective coating 104 may be formed over a portion of the exterior surface of the insert 130, and may be formed by the methods described above with reference to FIG. 1. For example, the protective coating 104 may be formed over a front cutting face 132 and a portion of a lateral side 134. The lateral side 134 may extend around the insert 130 in the shape of a cylinder wall. The protective coating 104 may be formed over the hard polycrystalline material 124, leaving supporting substrate 122 and the interface 126 uncoated.

Figure 4:
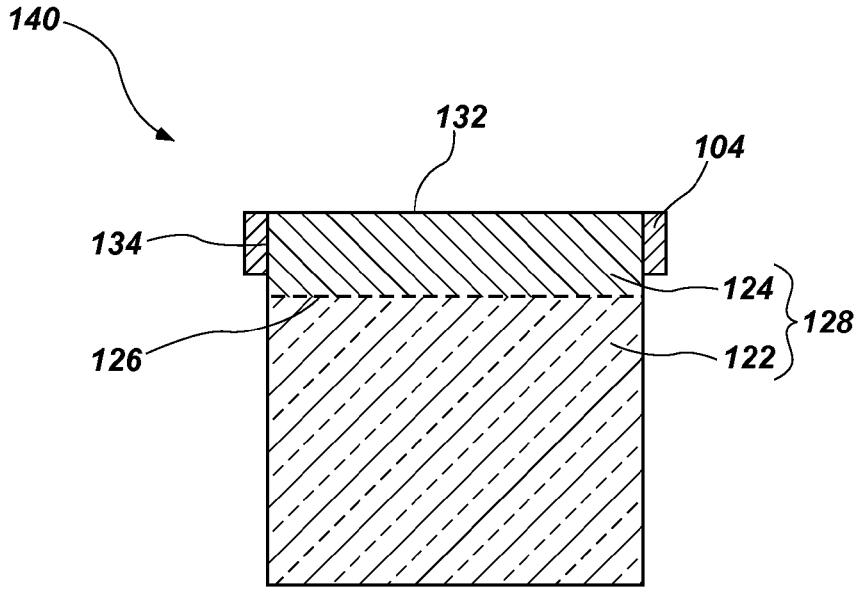

FIG. 4 is a simplified drawing illustrating a section cutaway view of an embodiment of an insert 140 having a protective coating 104 formed over a portion thereof. The insert 140 may have a PDC cutting element 128 comprising a supporting substrate 122, a table or layer of hard polycrystalline material 124, and an interface 126. Alternatively, the insert 140 may be formed without the supporting substrate 122 or the interface 126. The protective coating 104 may be formed over a portion of the exterior surface of the insert 140. For example, the protective coating 104 may be formed over a portion of the lateral side 134, leaving the front cutting face 132, the supporting substrate 122, and the interface 126 between the supporting substrate 122 and the hard polycrystalline material 124 exposed. The dimensions of the protective coating 104 may be selected such that, during a cutting operation, a shear lip forms. The shear lip may enhance cutting by providing a region of increased hardness to a cutting surface formed from at least a portion of the lateral side 134, as described in U.S. Patent Application Publication No. 2011/0088950 A1, titled "Cutting Elements Configured to Generate Shear Lips During Use In Cutting, Earth-Boring Tools Including Such Cutting Elements, and Methods of Forming and Using Such Cutting Elements and Earth-Boring Tools," published Apr. 21, 2011, the disclosure of which is incorporated herein in its entirety by this reference.

Figure 5:
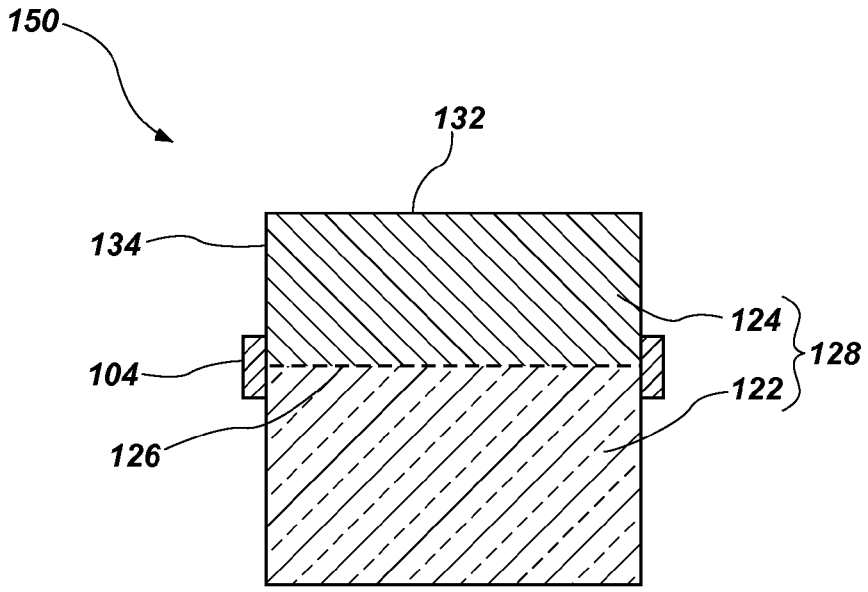

FIG. 5 is a simplified drawing illustrating a section cutaway view of an embodiment of an insert 150 having a protective coating 104 formed over a portion thereof. The insert 150 may have a PDC cutting element 128 comprising a supporting substrate 122, a table or layer of hard polycrystalline material 124, and an interface 126. The protective coating 104 may be formed over a portion of the exterior surface of the insert 150. For example, the protective coating 104 may be formed over a portion of the lateral side 134 surrounding the interface 126 between the supporting substrate 122 and the hard polycrystalline material 124. The front cutting face 132, a portion of the lateral side 134 of the hard polycrystalline material 124, and a portion of the lateral side 134 of the supporting substrate 122 may remain uncovered by the protective coating 104. The dimensions and placement of the protective coating 104 may be selected to protect the interface 126. In such embodiments, the insert 150 may sustain higher stress before failure than it would without the protective coating 104. Since the interface 126 is a natural breaking point, a protective coating 104 formed to strengthen the bond at the interface 126 may prolong a serviceable life of the insert 150.

Figure 6:
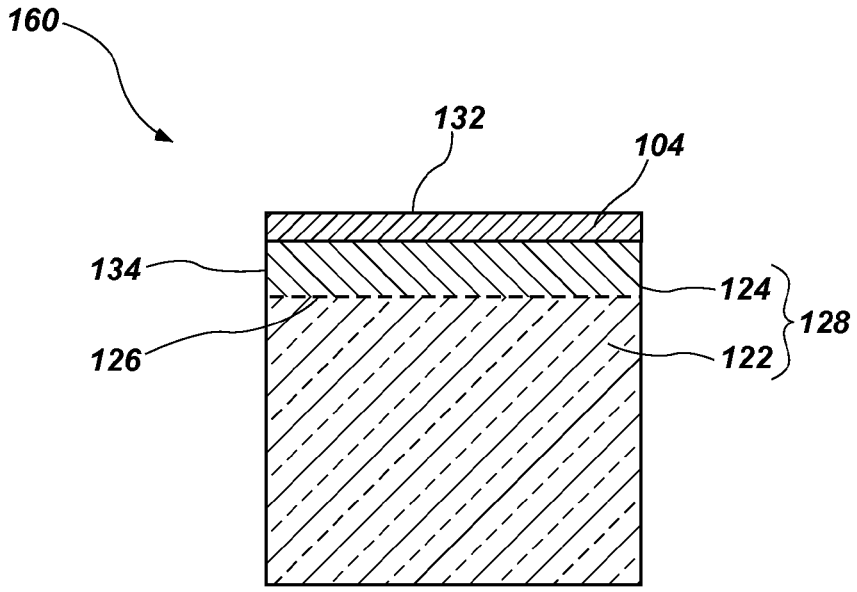

FIG. 6 is a simplified drawing illustrating a section cutaway view of an embodiment of an insert 160 having a protective coating 104 formed over a portion thereof. The insert 160 may have a PDC cutting element 128 comprising a supporting substrate 122, a table or layer of hard polycrystalline material 124, and an interface 126. Alternatively, the insert 160 may be formed without the supporting substrate 122 or the interface 126. The protective coating 104 may be formed over a front cutting face 132 of the insert 160. For example, all or substantially all of the lateral side 134 and the interface 126 between the supporting substrate 122 and the hard polycrystalline material 124 may remain exposed. The protective coating 104 may cover all or substantially all of the front cutting face 132, and may be harder than the underlying hard polycrystalline material 124. By applying a protective coating 104 to the front cutting face 132, an earth-boring tool in which the insert 160 is inserted may cut faster and last longer (e.g., may become worn or degraded more slowly) than an earth-boring tool into which an otherwise identical uncoated polycrystalline compact is inserted.

Figure 7:
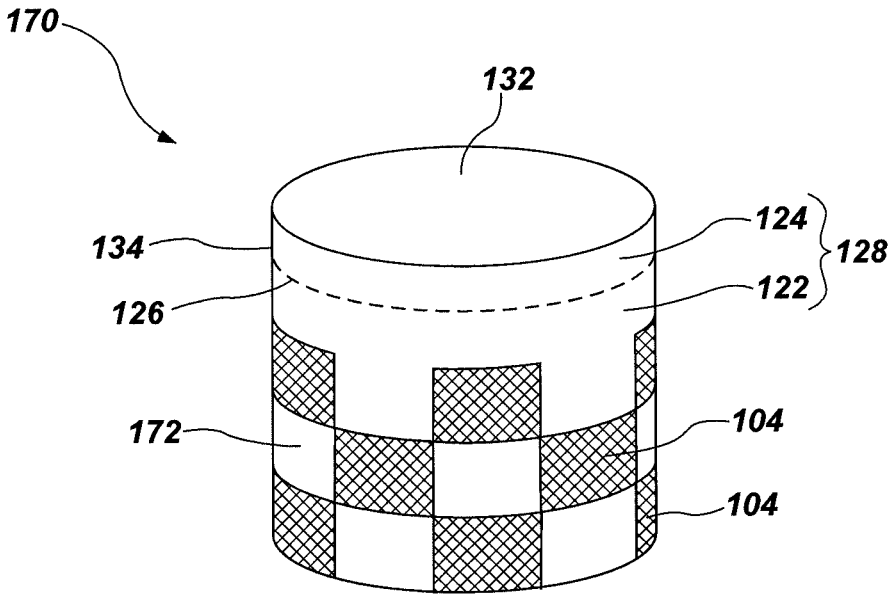
FIGS. 7 through 10 illustrate side views of embodiments of inserts for earth-boring tools of the present disclosure.

FIG. 7 is a simplified drawing illustrating a side view of an embodiment of an insert 170 having a protective coating 104 formed over a portion thereof. The insert 170 may have a PDC cutting element 128 comprising a supporting substrate 122, a table or layer of hard polycrystalline material 124, and an interface 126. Alternatively, the insert 170 may be formed without the supporting substrate 122 or the interface 126. The protective coating 104 may be formed over the lateral side 134 of the insert 170. The protective coating 104 may be formed in an ordered pattern or a random arrangement such that there are uncoated areas 172 of the lateral side 134. For example, the protective coating 104 may be an ordered pattern wherein uncoated areas 172 are rectangular in shape, with borders of the uncoated areas 172 in contact with a rectangle of protective coating 104. The lateral side 134 may comprise a "checkerboard" pattern, with alternating rectangles of protective coating 104 and uncoated areas 172 around at least a portion of the insert 170. In other embodiments, the borders of the uncoated areas 172 may be nonlinear (e.g., in the shape of circular arcs, polygons, etc., or in random shapes), and the protective coating 104 may be formed in shapes other than rectangles (e.g., polygons, circles, ellipses, etc.). The uncoated areas 172 may provide an area of adhesion between the insert 170 and an earth-boring tool into which the insert 170 may be inserted. The supporting substrate 122 may be formulated to be wettable by brazing materials (materials used to bond inserts into earth-boring tools). The uncoated areas 172 may effect bonding between the insert 170 and an earth-boring tool. The dimensions, geometry, and placement of the protective coating 104 may be selected based on the wettability of the supporting substrate 122 and protective coating 104 and the protection desired of the protective coating 104 to produce an insert 170 that may be secured in an earth-boring tool. In other words, the dimensions, geometry, and placement of the protective coating 104 may be selected to balance the strength of a bond between the insert 170 and an earth-boring tool with the protection provided by protective coating 104. The particular balance selected may depend on the earth-boring application, and may include considerations such as properties of the material to be bored through, desired cutting speed, and expected tool and earth temperatures.

Figure 8:
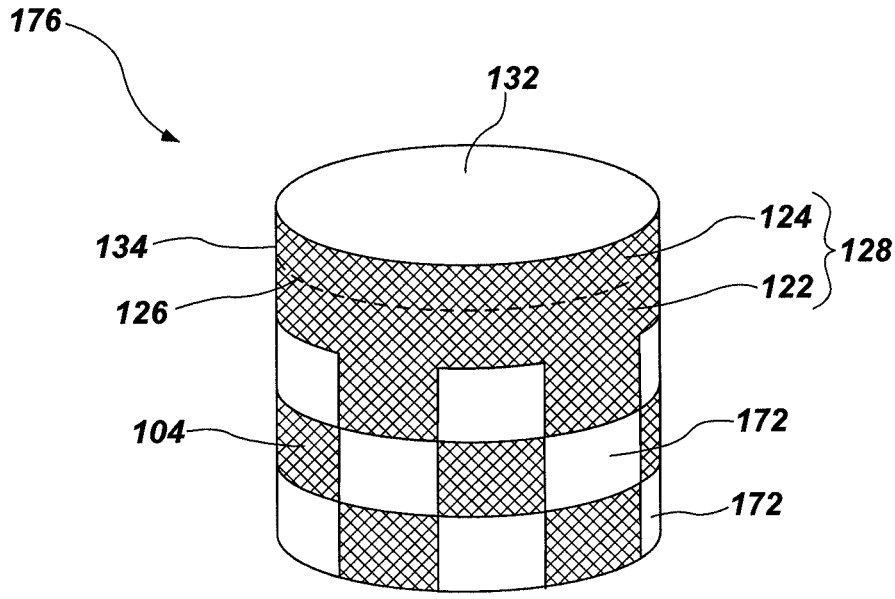

FIG. 8 is a simplified drawing illustrating a side view of an embodiment of an insert 176 having a protective coating 104 formed over a portion thereof. Insert 176 is similar to the insert 170 shown in FIG. 7, except that the protective coating 104 also covers the interface 126 in insert 176. In either insert 170 or 176, the protective coating 104 may cover the front cutting face 132.

Figure 9:
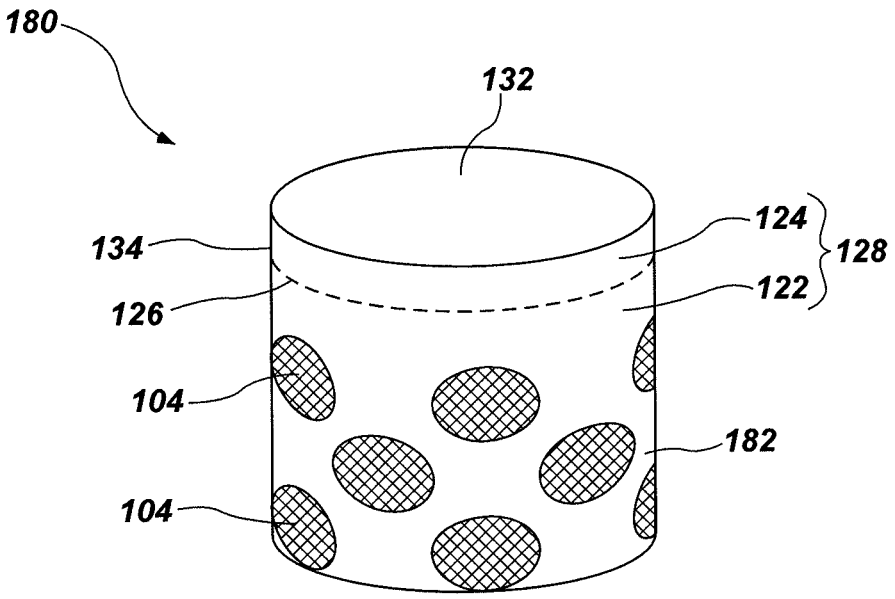

FIG. 9 is a simplified drawing illustrating a side view of an embodiment of an insert 180 having a protective coating 104 formed over a portion thereof. The insert 180 may be a PDC cutting element 128 comprising a supporting substrate 122, a table or layer of hard polycrystalline material 124, and an interface 126. Alternatively, the insert 180 may be formed without the supporting substrate 122 or the interface 126. The insert 180 may have a lateral side 134 with areas of protective coating 104. The areas of protective coating 104 may be formed in a pattern such that an uncoated area 182 is continuous and surrounds areas covered by the areas of protective coating 104. For example, areas of protective coating 104 may form circles, as shown in FIG. 9. In other embodiments, areas of protective coating 104 may form triangles, rectangles, ellipses, polygons, or any other shape. Though the areas of protective coating 104 shown in FIG. 9 are shown in an ordered pattern, the protective coating 104 may, in some embodiments, form a random arrangement. The continuous uncoated area 182 may provide an area of adhesion between the insert 180 and an earth-boring tool into which the insert 180 may be inserted. The supporting substrate 122 may be formulated to be wettable by brazing materials. The continuous uncoated area 182 may be used to effect bonding between the insert 180 and an earth-boring tool. The dimensions and placement of the areas of protective coating 104 may be selected based on the wettability of the supporting substrate 122 and protective coating 104 and the protection desired of the areas of protective coating 104 to produce an insert 180 that may be properly secured in an earth-boring tool. The dimensions, geometry, and placement of the areas of protective coating 104 may be selected to balance a strength of a bond between the insert 180 and an earth-boring tool with protection provided by protective coating 104. The continuous uncoated area 182 may provide a different bonding strength between the insert 180 and an earth-boring tool than that provided by the uncoated areas 172 of insert 170, shown in FIG. 7. For example, for a given bonding strength, use of a continuous uncoated area 182 of insert 180 may allow more surface area of the lateral side 134 to be covered with protective coating 104.

Figure 10:
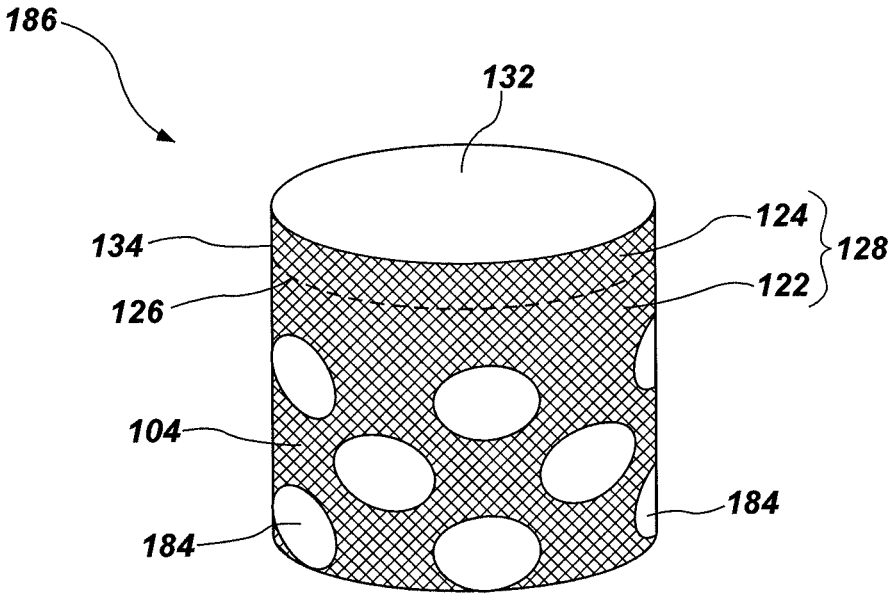

FIG. 10 is a simplified drawing illustrating a side view of an embodiment of an insert 186 having a protective coating 104 formed over a portion thereof. Insert 186 is similar to the insert 180 shown in FIG. 9, except that insert 186 includes discontinuous uncoated areas 184 formed in a pattern such that the protective coating 104 is continuous. The protective coating 104 covers the interface 126 of the insert 186. However, in other embodiments, the protective coating 104 does not cover the interface 126. In either insert 180 or 186, the protective coating 104 may or may not cover the front cutting face 132.

Figure 11:
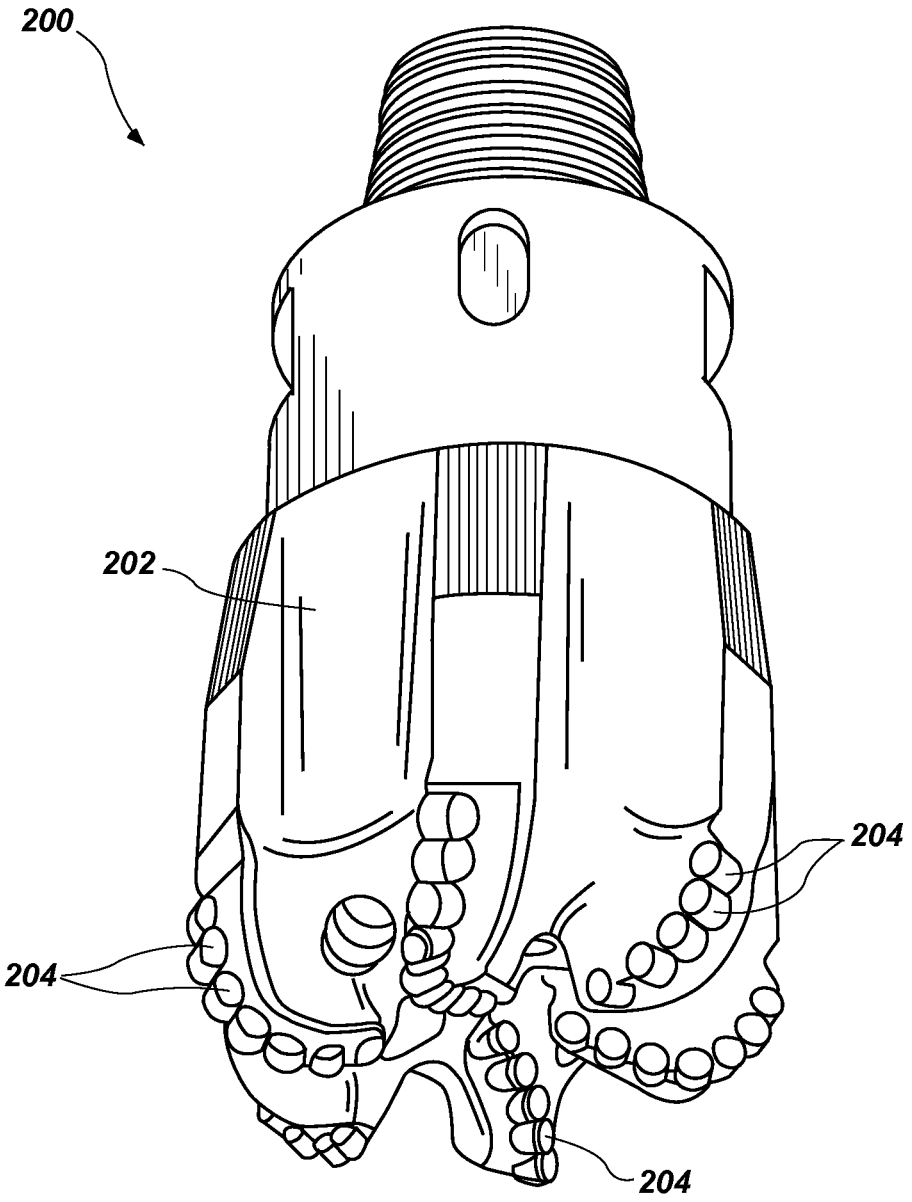
FIG. 11 is a perspective view of an embodiment of a fixed-cutter earth-boring rotary drill bit that includes a plurality of inserts for earth-boring tools like those shown in FIGS. 1 through 10.

Polycrystalline compacts that embody teachings of the disclosure may be formed and secured to earth-boring tools such as drill bits for use in forming wellbores in subterranean formations. As a non-limiting example, FIG. 11 illustrates a fixed-cutter type earth-boring rotary drill bit 200 that includes a plurality of inserts 204 (which may be any combination of inserts 100, 120, 130, 140, 150, 160, 170, 176, 180, or 186) as previously described herein. The rotary drill bit 200 includes a bit body 202. The inserts 204, which may serve as cutting elements, may be bonded to the bit body 202. The inserts 204 may be brazed (or otherwise secured) within pockets formed in the outer surface of the bit body 202. Earth-boring tools (e.g., drill bit 200) having coated inserts 204 may exhibit faster cutting speeds and/or longer useful life than they would if they had inserts 204 without such coatings.

Additional non-limiting example embodiments of the disclosure are described below.

Embodiment 1

An insert for an earth-boring tool, comprising a body and a coating disposed over at least a portion of the body. The coating comprises a ceramic comprising boron, aluminum, and magnesium.

Embodiment 2

The insert of Embodiment 1, wherein the body comprises a polycrystalline compact. The polycrystalline compact comprises a hard polycrystalline material.

Embodiment 3

The insert of Embodiment 2, wherein the coating is disposed over a front cutting face of the hard polycrystalline material.

Embodiment 4

The insert of any of Embodiments 1 through 3, wherein the coating is disposed over a lateral side of the body.

Embodiment 5

The insert of Embodiment 4, wherein the coating is disposed over two or more discontinuous areas of the body.

Embodiment 6

The insert of Embodiment 5, wherein discontinuous areas are disposed in an ordered pattern on the body.

Embodiment 7

The insert of any of Embodiments 1 through 6, wherein the body comprises a supporting substrate and a hard polycrystalline material secured to the supporting substrate.

Embodiment 8

The insert of Embodiment 7, wherein the coating is disposed over an interface between the hard polycrystalline material and the supporting substrate.

Embodiment 9

The insert of any of Embodiments 1 through 8, wherein the coating further comprises a plurality of composite fibers.

Embodiment 10

A polycrystalline diamond compact cutting element, comprising a hard polycrystalline material, a supporting substrate, and a coating disposed over at least a portion of the hard polycrystalline material. The coating comprises a ceramic of boron, aluminum, and magnesium.

Embodiment 11

The polycrystalline diamond compact cutting element of Embodiment 10, wherein the coating further comprises a material selected from the group consisting of $TiB_2$, TiC, $W_2B_5$, $W_2B_4$, $B_4C$, $Si_3N_4$, and $Al_2O_3$.

Embodiment 12

The polycrystalline diamond compact cutting element of Embodiment 10 or Embodiment 11, wherein the coating has a thickness of about 5 μm or less.

Embodiment 13

An earth-boring drill bit, comprising a bit body and at least one polycrystalline diamond compact cutting element secured to the bit body. The at least one polycrystalline diamond compact cutting element has a coating comprising a ceramic of boron, aluminum, and magnesium, and is disposed over at least a portion of a hard polycrystalline material.

Embodiment 14

The earth-boring drill bit of Embodiment 13, wherein the at least one polycrystalline diamond compact cutting element comprises a surface, wherein at least a portion of the surface is free of the coating.

Embodiment 15

The earth-boring drill bit of Embodiment 14, wherein the at least a portion of the surface free of the coating is bonded to the bit body.

Embodiment 16

A method of forming an insert for an earth-boring tool comprising forming a protective coating over a cutting element. The protective coating comprises a ceramic of boron, aluminum, and magnesium.

Embodiment 17

The method of Embodiment 16, further comprising forming a mixture comprising boron, aluminum, magnesium, and an additional material.

Embodiment 18

The method of Embodiment 17, further comprising milling the mixture to form a powder.

Embodiment 19

The method of Embodiment 18, further comprising disposing the powder over a surface of the cutting element and sintering the powder to form the protective coating.

Embodiment 20

The method of any of Embodiments 17 through 19, wherein the additional material is selected from the group consisting of titanium boride ($TiB_2$), silicon nitride ($Si_3N_4$), boron carbide ($B_4C$), titanium boride ($TiB_2$), and tungsten boride ($W_2B_4$).

Embodiment 21

The method of any of Embodiments 17 through 19, wherein the additional material comprises titanium carbide, iron, nickel, and carbon.

Embodiment 22

The method of any of Embodiments 16 through 21, wherein forming a protective coating over a cutting element comprises forming a protective coating by sputtering, laser formation, or plasma spraying.

Embodiment 23

The method of any of Embodiments 16 through 22, further comprising forming inter-granular bonds between the protective coating and the cutting element.

The foregoing description is directed to particular embodiments for the purpose of illustration and explanation. It will be apparent to one skilled in the art that many modifications and changes to the embodiments set forth above are possible without departing from the scope of the embodiments disclosed herein as hereinafter claimed, including legal equivalents. It is intended that the following claims be interpreted to embrace all such modifications and changes.

What is claimed is:

1. A cutting element insert for an earth-boring tool, comprising:

a supporting substrate having a top surface and a lateral surface;

a hard polycrystalline material secured to the top surface of the supporting substrate; and a coating extending around a circumference of the lateral surface of the supporting substrate, the coating disposed over and in contact with the supporting substrate;

wherein the lateral surface of the supporting substrate comprises a first exposed portion and a second exposed portion, the first exposed portion spatially separated from the second exposed portion, the first exposed portion and the second exposed portion each substantially free of the coating; and wherein the coating comprises a ceramic comprising boron, aluminum, and magnesium.

2. The cutting element insert of claim 1, wherein the coating is further disposed over and in contact with a front cutting face of the hard polycrystalline material.

3. The cutting element insert of claim 1, wherein the coating is disposed over and in contact with a lateral side of the hard polycrystalline material and the lateral surface of the supporting substrate.

4. The cutting element insert of claim 1, wherein the coating further comprises a plurality of composite fibers.

5. The insert of claim 1, wherein the coating is at least substantially comprised of the ceramic comprising boron, aluminum, and magnesium.

6. The insert of claim 1, wherein the hard polycrystalline material comprises diamond.

7. A polycrystalline compact cutting element, comprising:

a hard polycrystalline material;

a supporting substrate;

a first volume of a coating material disposed over and in contact with a lateral surface of the supporting substrate; and a second volume of the coating material disposed over and in contact with the lateral surface of the supporting substrate, the second volume of the coating material distinct and spatially separated from the first volume of the coating material such that at least a portion of the lateral surface of the supporting substrate is free of the coating material;

wherein the coating material comprises a ceramic comprising boron, aluminum, and magnesium.

8. The polycrystalline compact cutting element of claim 7, wherein the coating further comprises a material selected from the group consisting of $TiB_2$, TiC, $W_2B_5$, $W_2B_4$, $B_4C$, $Si_3N_4$, and $Al_2O_3$.

9. The polycrystalline compact cutting element of claim 7, wherein the coating has a thickness of about 5 μm or less.

10. An earth-boring drill bit, comprising:

a bit body; and at least one polycrystalline diamond compact cutting element secured to the bit body, the at least one polycrystalline diamond compact cutting element comprising:

a hard polycrystalline material;

a supporting substrate;

a first volume of a coating material disposed over and in contact with a lateral surface of the supporting substrate, and a second volume of the coating material disposed over and in contact with the lateral surface of the supporting substrate, the second volume of the coating material distinct and spatially separated from the first volume of the coating material such that at least a portion of the lateral surface of the supporting substrate is free of the coating material;

wherein the coating material comprises a ceramic comprising boron, aluminum, and magnesium.

11. The earth-boring drill bit of claim 10, wherein the at least a portion of the lateral surface of the supporting substrate being free of the coating is bonded to the bit body.

12. A method of forming an insert for an earth-boring tool, comprising:

forming a first volume of a protective coating over and in contact with a lateral surface of a supporting substrate of a cutting element; and forming a second volume of the protective coating over and in contact with the lateral surface of the supporting substrate of the cutting element, the second volume of the coating material distinct and spatially separated from the first volume of the coating material such that at least a portion of the lateral surface of the supporting substrate is free of the coating material;

wherein the protective coating comprises a ceramic comprising boron, aluminum, and magnesium.

13. The method of claim 12, further comprising forming a mixture comprising boron, aluminum, magnesium, and an additional material.

14. The method of claim 13, wherein the additional material is selected from the group consisting of titanium boride ($TiB_2$), silicon nitride ($Si_3N_4$), boron carbide ($B_4C$), titanium boride ($TiB_2$), and tungsten boride ($W_2B_4$).

15. The method of claim 13, wherein the additional material comprises titanium carbide, iron, nickel, and carbon.

16. The method of claim 12, wherein forming a first volume of a protective coating over a supporting substrate of a cutting element comprises forming a protective coating by sputtering, laser formation, or plasma spraying.

17. The method of claim 12, further comprising forming inter-granular bonds between the protective coating and the supporting substrate of the cutting element.

* * * * *